US005901810A

United States Patent [19]

Krause

[11] Patent Number: 5,901,810

[45] Date of Patent: May 11, 1999

[54] FRAME COMPONENT

[75] Inventor: Günther Krause, Alsfeld, Germany

[73] Assignee: Krause-Werk GmbH & Co. KG, Alsfeld-Altenburg, Germany

[21] Appl. No.: 08/776,205

[22] PCT Filed: May 24, 1995

[86] PCT No.: PCT/EP95/01972

§ 371 Date: Apr. 3, 1997

§ 102(e) Date: Apr. 3, 1997

[87] PCT Pub. No.: WO96/01933

PCT Pub. Date: Jan. 25, 1996

[30] Foreign Application Priority Data

Jul. 8, 1994 [DE] Germany ..... 94 10 743 U

[51] Int. Cl.[6] ..... E04G 7/00

[52] U.S. Cl. ..... 182/178.5; 182/178.1

[58] Field of Search ..... 182/178.1–178.6

[56] References Cited

U.S. PATENT DOCUMENTS 3,037,588 6/1962 Causey ..... 182/178.6

FOREIGN PATENT DOCUMENTS 2032504 5/1980 United Kingdom ..... 182/178.6

*Primary Examiner*—Daniel P. Stodola
*Assistant Examiner*—Hugh B. Thompson
*Attorney, Agent, or Firm*—Flynn, Thiel, Boutell & Tanis, P.C.

[57] ABSTRACT

Scaffoldings are usually either movable or fixed. Structures usable for both are usually too bulky and complicated, and therefore not suitable for general use. The invention provides a solution because the platforms are interchangeable on the scaffolding frames and the frame components are equipped with a grid for the connection components of the other structural components involved. The frame components are thereby, in spite of the extensive use of light structural sections, extraordinarily torsion resistant. The invention can be designed to be extensively modular.

21 Claims, 5 Drawing Sheets

FRAME COMPONENT

FIELD OF THE INVENTION

The invention relates to a frame component having two posts, which preferably have a circular-pipe shape in cross section and are rigidly connected with one another adjacent their ends by horizontal cross-traverses, for a vertical scaffolding frame of a stationary and/or movable scaffolding of prefabricated structural components. The frame component is used for the releasable connection of horizontal, rectangular platforms, which can be placed on the cross-traverses or similar structural components of two adjacent frame components, thereby covering a cross section of the respective cross-traverse, and defining the distance between the associated scaffolding frames. The platforms can be equipped with openings and define longitudinal and/or transverse side pieces. The frame components are joined with diagonal longitudinal and/or transverse reinforcements, which can be fastened to the frame components, and/or longitudinally and/or transversely extending railing and/or intermediate spars or other structural components.

BACKGROUND OF THE INVENTION

Scaffoldings of prefabricated structural components, which are to be fastened stationarily to the building, and, if necessary, can be converted into movable scaffoldings, have been known for a long time. However, an extensive use of these scaffoldings is hindered by the platforms not being able to be connected at variable heights to the scaffolding frames, and, in particular, also not being able to be installed and removed or elevationally shifted as desired and without a large effort for the complete assembly of the scaffolding. The locks usually used for connecting the remaining structural components to the posts are quite susceptible to wear, require considerable labor for installation and removal, and are also cumbersome during transport and stacking of the frame components. The connecting of the spars and reinforcements is fixed at certain heights by the stationary scaffolding and has little flexibility in order to be able to also be successfully used on a mobile scaffolding, on which these heights must be significantly more variable. The laterally defining scaffolding frames differ in addition from the others by having rigidly fastened ladder rungs for climbing so that a second type of frame components must be provided.

The basic purpose of the invention is therefore to provide a frame component of the type discussed in detail above in such a manner that the disadvantages of the conventional scaffolding frames are eliminated, and, in particular, that the platforms can be suspended, removed and changed as desired on a completely assembled scaffolding. The connection of all structural components on the posts is possible in a simple manner with similar connecting components and at relatively narrow-joints elevationally positioned on a grid. The frame components can be equipped also with crossbars serving as ladder rungs. The frame components must be easily stackable, and must be designed such that none of the side surfaces parallel to the building, on which work is to be done, is designed with a protrusion and that each of these side surfaces can be used as a work front.

SUMMARY OF THE INVENTION

The purpose is attained according to the invention by the posts having in a convenient manner at their one end a first part closing off the respective post, for example an integrated pipe piece, and at their other end a second part complementary thereto and projecting over the respective post, for example a bolt piece of a lockable telescoping coupling, by the connections of the cross-traverses being provided at the posts with torsion-hindering reinforcements preferably stabilizing the rectangular shape of the frame component, and by the upper cross-traverse being constructed continuously and being connected directly to the posts and the lower cross-traverse, on both sides being bent downwardly to form first reinforcements, is connected to the posts.

Such an arrangement has the great advantage that the lower cross-traverse can be mostly positioned into the space between adjacent platforms at the same level, and in spite of this the remaining parts of the cross-traverse are available as connecting components on both sides above the platforms for all other structural components of the scaffolding. At the same time, a reinforcing action is achieved with the distortion resistance of the cross-traverse having been improved in several directions.

A preferred design of the frame component of the invention is obtained when the lower cross-traverse consists of two short, horizontal first brackets connected on both sides at the same height to the posts, a plate mounted pointing downwardly on each of the free ends of the first brackets, which ends are directed toward one another, and forming together with the associated bracket a respective first reinforcement, and a horizontal reinforcement being fastened on both ends to the plate positioned at a vertical distance from the axis of the first brackets. The reinforcement and the plates are thereby not used as a bearing surface or for receiving a connecting component, and can therefore be constructed relatively light without endangering the reinforcement of the frame component at its lower end. It can therefore be sufficient when the plates are constructed as a sheet-metal section and/or the reinforcement and/or the plates have a rectangular, preferably flat-rectangular cross section. It is particularly advantageous when the lower cross-traverse is fastened to the posts in such a manner that the underside of the reinforcement is approximately flush with the lower ends of the posts because then, on the one hand, the bent section of the cross-traverse largely projects above the adjacent platform, and, on the other hand, does not project below the lower ends of the posts so that the upper cross-traverse can be provided in the direct vicinity, however, still at the upper end of the posts.

Particularly advantageous is a design in which the brackets of the lower cross-traverse are fastened so far above the associated reinforcement plates and are spaced at such a distance from the upper cross-traverse of the downward adjacent frame component, that a connecting component of a platform or the like, which connecting component can be placed onto the upper cross-traverse and thereby covers its cross section, can be mounted with the plug coupling being received into the upper cross-traverse or can be removed therefrom. In this manner it is possible, even on a completely installed scaffolding, to at any time remove the platform and, if necessary, suspend same again at another point. On the other hand, the brackets of the lower cross-traverse continue to be available for connecting components of other structural components even when a platform rests on the adjacent upper cross-traverse of the adjacent frame component so that the respective joint of the scaffolding frame can be used simultaneously for several structural components.

The inherent stability of the frame component can be improved when the upper cross-traverse is connected at its underside adjacent both ends to diagonal rods defining second reinforcements and is connected to the posts, which diagonal rods can be connected advantageously to the posts through short, horizontal second brackets suited for connecting platforms, reinforcements, spars, boards, or other structural components thereto. In this manner it is possible to fasten a further connecting component to the respective joint of the scaffolding frame. If one takes care that the apex of the upper cross-traverse is thereby approximately flush with the upper ends of the post, then the ends of the posts do not project thereabove and the cross-traverses adjacent to the joint are closely positioned next to one another or actually rest on one another. Thus the size of the bent section of the lower cross-traverses is limited.

A frame component of the invention can be utilized extraordinarily variably when short, horizontal third brackets suited for connecting of platforms, reinforcements, spars, boards or other structural components are provided on the posts between the cross-traverses. These third brackets can thereby be provided so that all or part thereof extend into the area between the posts, and it is advantageous when the third brackets are provided at least partially in pairs at the same height. Thus it is possible to provide structural components along both the longitudinal surfaces and also along the transverse side surfaces of the scaffolding, and to maintain thereby a select symmetry of the scaffolding so that neither of its two longitudinal surfaces is preferred. This is particularly advantageous in the case of mobile scaffoldings. Crossbars can be placed onto the brackets serving as ladder rungs.

The compatibility of the frame components for both types of scaffoldings is further improved when the third brackets are fastened to the posts in such a manner that they together with the upper cross-traverses construct a grid with each element separated by the same height. This grid is also not bothered by the joints of the scaffolding. It determines the possible distances between the ladder rungs when the (third) brackets are connected with one another through the (laid-on) crossbars, and enables the elevational shifting of platforms within the height of the frame component of the invention.

The connecting components of all structural components connectable to the posts can be designed essentially uniformly when the upper cross-traverse, and/or the diagonal rods, and/or the brackets have a similar cross section. These cross sections can always be received in the same manner when the connecting component, without any consideration to the direction of the structural component, is fastened in the area to the third bracket so that it can always slide vertically from above over the cross section of the third bracket even if the third bracket is not constructed circumferentially symmetrically but instead is composed in a preferred manner of a first lower, rectangular partial cross section and an integrally connected upper, preferably upwardly semicircularly-shaped arched second partial cross section. Such a cross section has a high resistance moment against bending with an efficient mounting of the corresponding connecting component while avoiding stress points in the participating structural parts.

The light-weight construction of such a frame component is enhanced when its structural parts are connected with one another throughout, or partially, by means of welding seams, and/or are preferably constructed as extruded hollow sections.

The frame components can be easily stacked when the width of the cross sections of the cross-traverse and of the third brackets are dimensioned such that their connections to the posts are slightly less than the width of the posts.

The frame components of the invention make it possible to construct a scaffolding in a modular manner both stationarily and also transportably, which scaffolding can be adapted even in a completely set-up state to changing conditions at the building site so that expensive transports and complicated storage of the needed structural components is avoided.

BRIEF DESCRIPTION OF THE DRAWINGS

The invention will be discussed hereinafter in greater detail in connection with one exemplary embodiment and the drawings, in which.

Figures 1, 2:
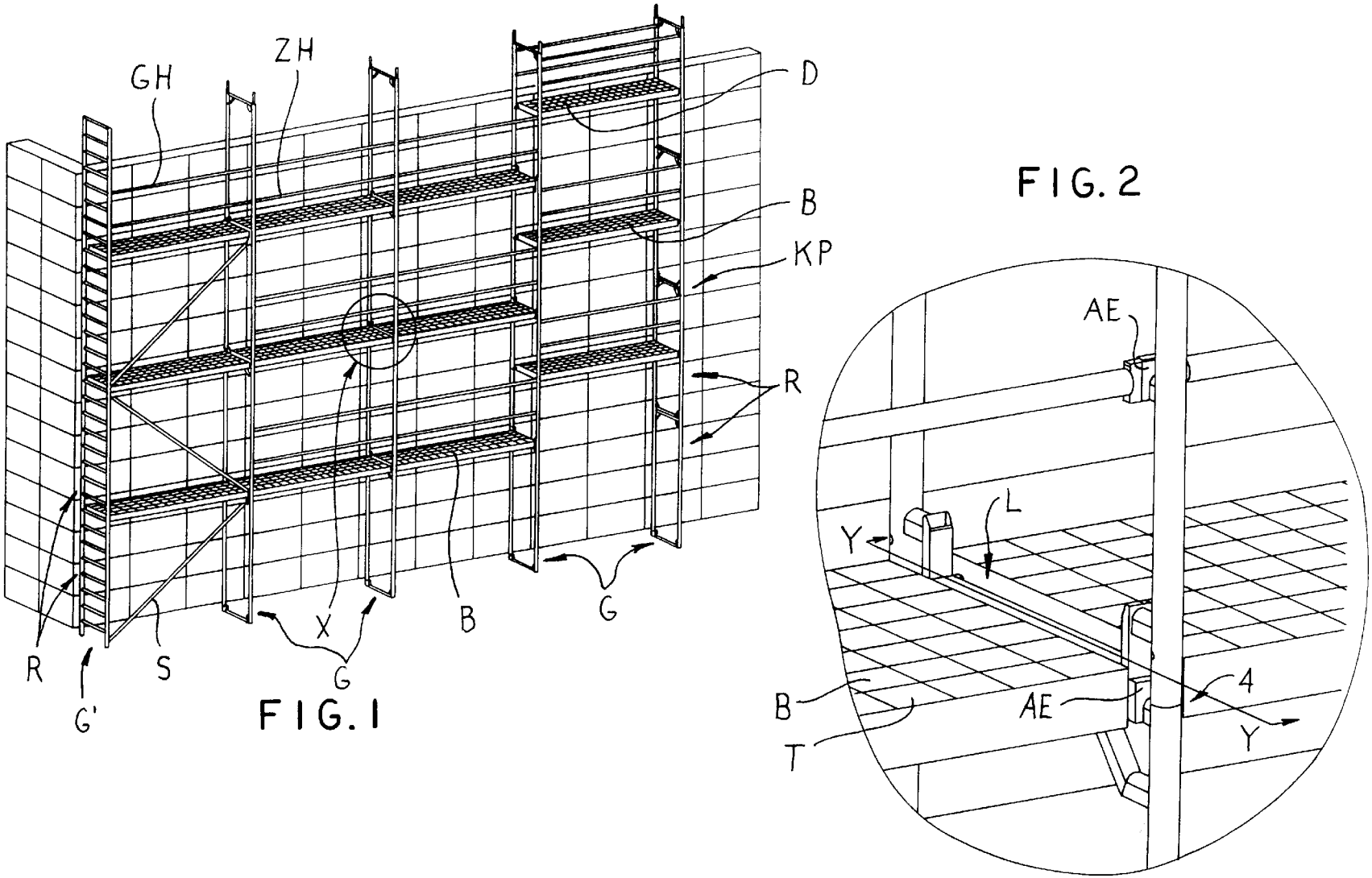
FIG. 1 is an overall view of a scaffolding built with frame components of the invention.
FIG. 2 shows a detailed view of area X of FIG. 1, slightly enlarged, both in the same orientation of a perspective illustration.

The scaffolding corresponding to FIG. 1 consists first of all of four scaffolding frames G with frame components R according to the invention and a scaffolding frame G' with frame components R', which are not part of the invention, which scaffolding frame is here used as a ladder onto the scaffolding. The scaffolding frame G' can be easily replaced with a scaffolding frame G. The scaffolding frames G, G' are connected with one another by platforms B, diagonal longitudinal reinforcements S and longitudinally extending railing spars GH and intermediate spars ZH. The platforms B are equipped in a conventional manner partly with openings D and longitudinal and transverse side pieces LS, TS.

Figure 3:
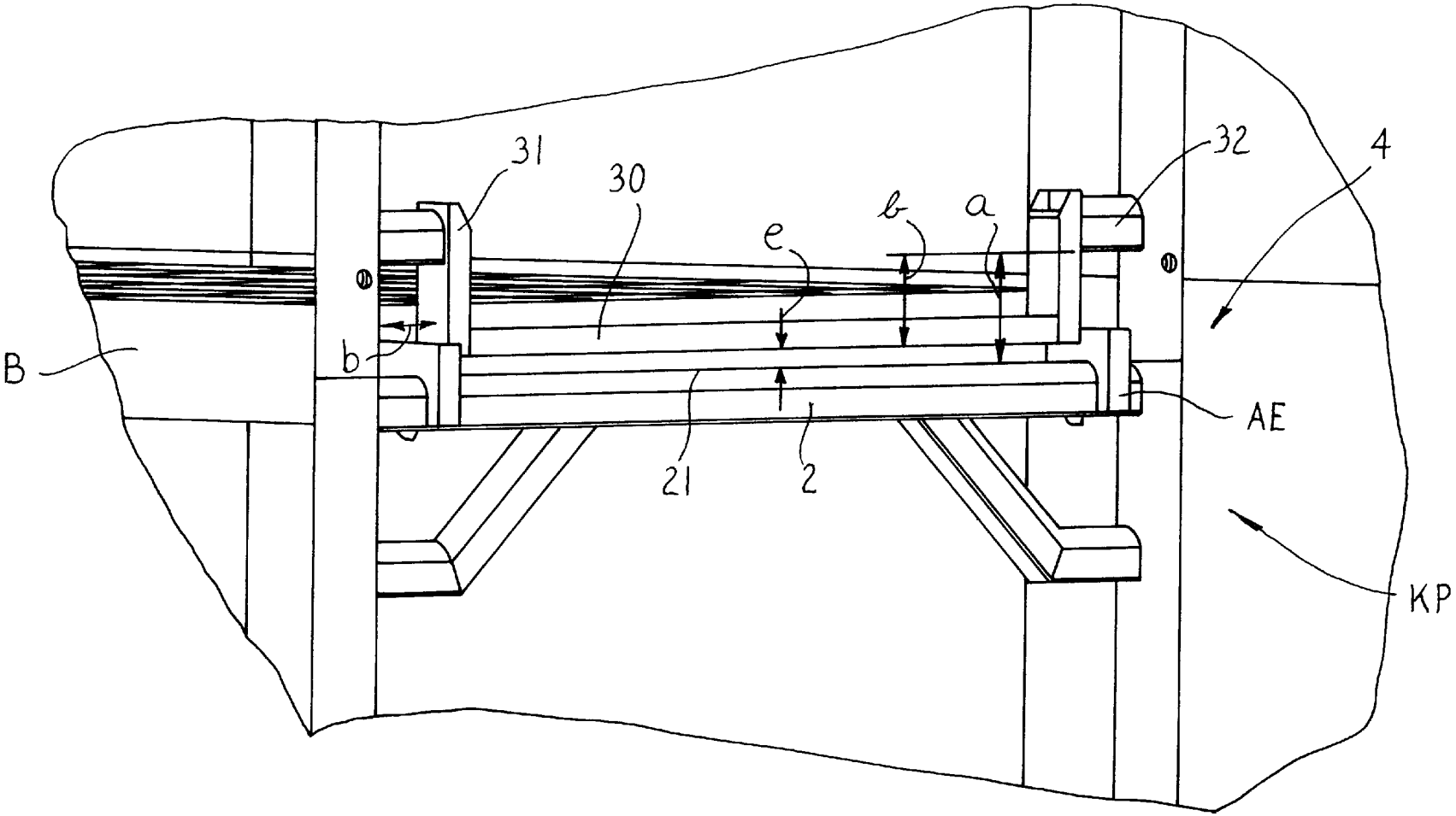
FIG. 3 is a view taken along Y in FIG. 2 with the viewing axis changed when compared to FIG. 2, and again enlarged.
Figure 4:
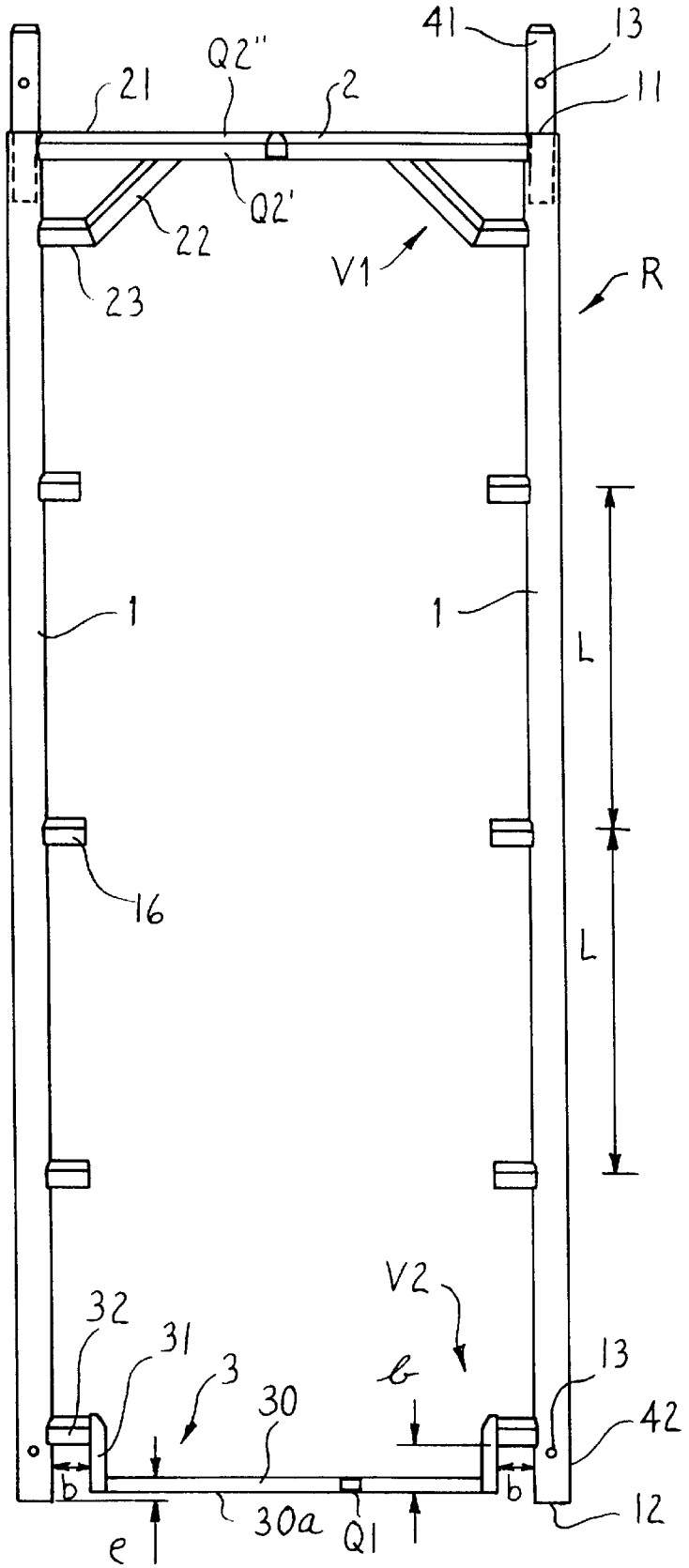
FIG. 4 is the view of a frame component of the invention, FIG. 5 being a modification of FIG. 4, and FIG. 6, in an enlarged perspective illustration, shows stacked stored frame components corresponding to FIG. 4 or 5 in the area of the lower cross-traverses compared with FIGS. 4 and 5, all in a schematically simplified illustration.
Figure 5:
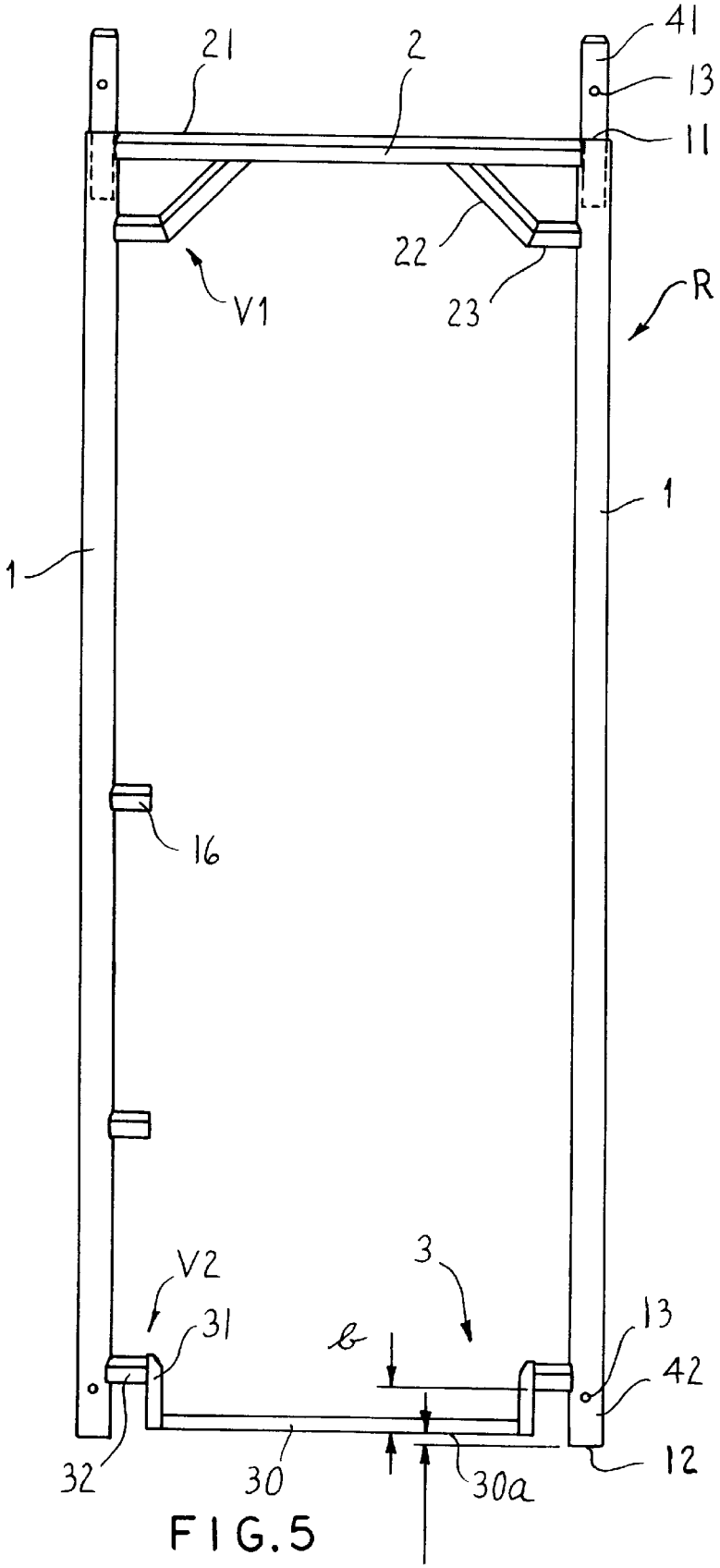

A frame component R of the invention consists according to FIGS. 4 and 5 of two parallel, pipe-shaped posts 1 which are rigidly connected at their upper and lower ends 11, 12 each by an upper cross-traverse 2 and a lower cross-traverse 3 so that a torsion-resistant, load-bearing structural component is created. A telescoping coupling 4 is created at the ends 11 and 12 (FIGS. 2 and 3) in such a manner that the upper ends 11 of the posts 1 are constructed as bolt pieces 41 and the lower ends 12 as socket pieces 42, whereby these socket pieces 42 each are easily unitarily formed from a portion of the post 1. A bolt lock locks the two parts 41, 42 with one another by being received in locking holes 13 which can be aligned. Thus several frame components R can be placed onto one another where the telescoping couplings 4 are constructed, that is where the upper and the lower cross-traverses 2 and 3 are each directly adjacent to one another.

The cross-traverse 2, which is constructed as a linear piece, is welded to the posts 1 at both its ends. Its apex 21 is thereby flush with the upper end 11 of the post on which rests the lower end 12 of the next higher post 1 of the complete scaffolding frame G. The stress on the cross-traverse 2 is relieved by diagonal rods 22, which serve in particular to direct the bearing forces of a platform B resting on the cross-traverse 2 into the posts 1, and are each connected by means of a short, horizontal first bracket 23 to the post 1 welded to the bottom of the diagonal rod 22. Since the bracket 23 is here also connected to the post 1 via a welding seam, there results as a whole a reinforcement bracing between the cross-traverse 2 and the posts 1, a first reinforcement V2 being at the lower cross-traverse 3, a second reinforcement V1 being defined at the bracket 23, to reinforce the frame component R as a whole.

The lower cross-traverse 3, which is bent at both ends thereof, includes a brace 30, to both ends of which are welded vertically upwardly directed, sheet-metal plates 31 which are each spaced at a width b from the adjacent post 1. The plates 31 connect the brace 30 to second brackets 32 welded to the outer sides of the plates 31, which brackets are otherwise connected to the posts 1. The brackets 32 are thereby arranged on the plates 31 elevationally offset at the height h with respect to the brace 30. The lower cross-traverse 3, including brackets 32, has a generally U-shaped profile viewed from the sides, as shown in FIG. 4. The underside 30*a* of the brace 30 is upwardly offset to the respective lower end 12 of the posts 1 by a set back distance e, so that it is spaced by this amount from the upper traverse 2 positioned below on another frame, as this can be particularly well recognized in FIG. 3. The sum of the distance e and the height h results in an interior distance a between the respective brackets 32 and the apex 21 of the next upper cross-traverse 2, which is dimensioned such that hook-shaped connecting elements AE of the laid-in platform B, as shown in FIGS. 2 and 3, can be lifted off upwardly and can then be removed from the space between the plates 31 and the posts 1. It is thus possible to remove or insert the platform B without demounting the telescoping coupling 4 of the joint KP (FIG. 3). FIG. 2 clearly shows that the brace 30 closes thereby the gap L between adjacent platforms B. Its flat-rectangular cross section Q1 (FIG. 4) is thereby slightly lowered below the stepping surface T (FIG. 2) of the platform B, which is not a problem and, on the other hand, has the advantage that the brace 30 can be used as a bearing surface for a board when the frame component R is provided at the bottom of the scaffolding frame G.

Third, short horizontal brackets 16 are welded to the posts 1, either in the space provided in the frame component R between the posts 1, or also in an angularly offset arrangement not shown in the drawings, for example, for connecting structural components which extend in a direction from the front surfaces of the scaffolding. The brackets 16 point inwardly from the frame component R and are as a rule, as shown in FIG. 4, arranged in pairs at the same height. FIG. 5 shows that also irregular arrangements are possible.

All brackets 16, 23, 32, the upper cross-traverse 2 and the diagonal rods 22 have the same cross section Q2 throughout (indicated in the upper cross-traverse 2 in FIG. 4), which is composed of a first lower, rectangular partial cross section Q2' and integrally adjacent therewith an upper, upwardly semicircularly arched second partial cross section Q2". The cross section Q2 is (FIG. 3) well suited to connect the connecting elements AE of the structural components to be connected to the scaffolding frame G. The connecting elements AE are designed hook-shaped and slide over the cross section Q2 and are there, if necessary, locked thereon.

The arrangement of FIGS. 1 and 4 shows that the brackets 16 together with the upper cross-traverse 2 construct there an elevational grid with a constant grid element separation r so that the scaffolding can be varied as desired without providing special structural components for this purpose.

Figure 6:
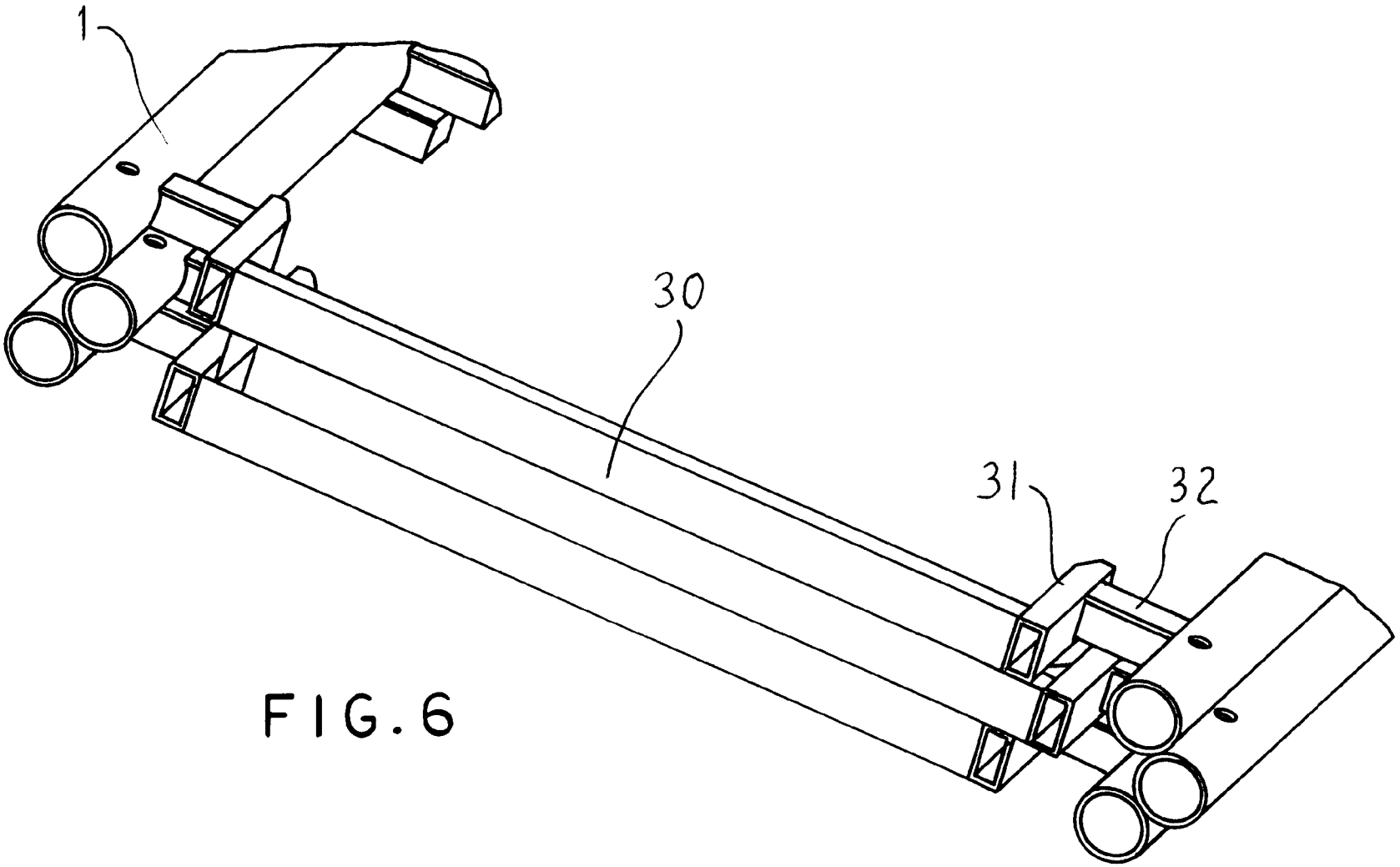

The frame components R can be easily stacked (FIG. 6) because the cross sections Q1 and Q2 of all structural components are slightly receded between the posts 1 with respect to the width thereof so that the frame elements R can be stacked one on top of the other in a space-savingly alternating off-set manner. They are relatively light because most structural components can be easily, and moreover inexpensively manufactured as extruded hollow profiles.

I claim:

1. A frame component for a scaffolding frame of a scaffolding manufactured out of prefabricated structural components, which scaffolding frame is to be set up vertically, (a) comprising two posts rigidly connected with one another adjacent their ends by cross-traverses including an upper cross-traverse and a lower cross-traverse, that are horizontal in operating condition, the two posts being circular-pipe shaped in cross section, whereby (b) the posts have at one end a first part closing off the respective post, and at the other end a second part complementary to the first part and projecting over the respective post, (c) connections of the upper cross-traverse to the posts are provided with torsion-hindering reinforcements stabilizing the frame component, (d) the upper cross-traverse is constructed continuously and is connected directly to the posts, (e) the lower cross-traverse connects on both ends to the posts, the lower cross-traverse comprises two opposing brackets connected to said posts and extending into an area between the posts, two elements having ends mounted on the free ends of the brackets, and a brace mounted to opposing ends of the elements, wherein the brackets, the elements, and the brace, in combination, comprise the lower cross-traverse, and (f) at least one bracket is mounted horizontally on at least one post, the reinforcements of the upper cross-traverse being fastened to the posts through brackets, wherein the horizontal bracket, the brackets of the upper cross-traverse, and the brackets of the lower cross-traverse brackets have substantially the same cross-section.

2. The frame component according to claim 1, wherein the brackets of the lower cross-traverse comprise two short, horizontal brackets connected on both sides at the same height to the posts, the elements comprising plates mounted pointing downwardly on each of the free ends of the brackets, of the lower cross-traverse the free ends of the brackets facing toward one another; the brace fastened on both sides to respective ones of the plates, the brace being positioned a spaced vertical distance from the axis of the brackets of the lower cross-traverse.

3. The frame component according to claim 2, wherein the plates are constructed as a sheet-metal section.

4. The frame component according to claim 2, wherein the brace has a rectangular cross section.

5. The frame component according to claim 2, wherein the lower cross-traverse is fastened to the posts in such a manner that the underside of the brace is approximately flush with lower ends of the posts.

6. The frame component according to claim 2, wherein the brackets of the lower cross-traverse are fastened above the associated brace on the plates and are spaced a distance from an adjacent downwardly positioned one of the upper cross-traverses of the frame component, the arrangement enabling placement of a connection component of a platform onto the upper cross-traverse and thereby covering a cross section thereof, and a removable plug coupling being received on the upper cross-traverse.

7. The frame component according to claim 1, wherein an underside of the upper cross-traverse connects to diagonal rods constructing the reinforcements, the diagonal rods being connected to the posts.

8. The frame component according to claim 7, wherein the diagonal rods are connected to the posts through horizontal brackets including the at least one horizontal bracket, the horizontal brackets comprising short, horizontal brackets suited for connecting platforms, the reinforcements, spars, boards, or other structural components.

9. The frame component according to claim 7, wherein an apex of the upper cross-traverse is approximately flush with upper ends of the posts.

10. The frame component according to claim 1, wherein the brackets comprise short, horizontal brackets suited for connecting of platforms, the reinforcements, spars, boards or other structural components, the first brackets being provided on the posts.

11. The frame component according to claim 10, wherein the brackets are provided extending into the area between the posts.

12. The frame component according to claim 10, wherein the brackets are provided in pairs at the same level.

13. The frame component according to claim 10, wherein the brackets of the upper cross-traverses are fastened to the posts in such a manner that, in combination with the upper cross-traverses, the second brackets form a grid having grid elements separated by the same height.

14. The frame component according to claim 10, wherein widths of cross sections of the cross-traverses and of the brackets are dimensioned such that their connections to the posts are slightly smaller than widths of the posts.

15. The frame component according to claim 1, wherein the upper cross-traverse and diagonal rods have a similar cross section.

16. The frame component according to claim 15, wherein the cross section is composed of a first lower, rectangular partial cross section and an integral adjacent upper semi-circularly, arched second partial cross section.

17. The frame component according to claim 1, wherein the posts, the cross-traverses, and the brackets are constructed as extruded hollow sections.

18. The frame component according to claim 1, wherein the brackets are connected to the respective posts by means of welding seams.

19. A frame component for a scaffolding frame of a scaffolding manufactured out of prefabricated structural components, which scaffolding frame is to be set up vertically, (a) comprising two posts rigidly connected with one another adjacent their ends by cross-traverses including an upper cross-traverse and a lower cross-traverse, that are horizontal in operating condition, the two posts being circular-pipe shaped in cross section, whereby (b) the posts have at one end a first part closing off the respective post, and at the other end a second part complementary to the first part and projecting over the respective post, (c) connections of the cross-traverses to the posts are provided with first and second torsion-hindering reinforcements stabilizing the frame component, (d) the upper cross-traverse is constructed continuously and is connected directly to the posts, and (e) at least one first bracket is mounted horizontally on at least one post, the second reinforcements of the upper cross-traverse being fastened to the posts through second brackets, the lower cross-traverse being mounted to the posts through third brackets, the upper cross-traverse and the first, second, and third brackets having substantially the same cross-section, wherein the cross-section is composed of a first lower, rectangular partial cross-section and an integral adjacent upper semi-circularly, arched second partial cross-section.

20. A scaffolding frame component of a scaffolding, said scaffolding frame component comprising:

two posts having circular-pipe shaped cross-sections;

an upper cross-traverse connecting said two posts near top ends thereof, said upper cross-traverse being substantially perpendicular to lengths of said two posts when secured thereto;

a lower cross-traverse connecting said two posts near bottom ends thereof, said lower cross-traverse comprising two opposing substantially horizontal brackets connected to said posts and extending into an area between said posts, two elements having upper ends mounted on the free ends of said brackets, and a substantially horizontal brace mounted to opposing lower ends of said elements, wherein said horizontal brackets, said elements, and said horizontal brace, in combination, comprise said lower cross-traverse, said horizontal brace of said lower cross-traverse being substantially perpendicular to the lengths of said two posts.

21. The scaffolding frame component of claim 20, wherein said elements comprise plates secured substantially perpendicular to said horizontal brace, said lower cross-traverse having substantially a U-shape between said posts whereby, when a second upper cross-traverse is secured to said posts immediately adjacent and below said lower cross-traverse in forming scaffolding, said U-shape of said lower cross-traverse enabling placement of connection components at ends of said upper cross-traverse aligned with said brackets of said lower cross-traverse.

* * * * *

UNITED STATES PATENT AND TRADEMARK OFFICE

CERTIFICATE OF CORRECTION

PATENT NO. : 5 901 810

DATED : May 11, 1999

INVENTOR(S) : Guenther KRAUSE

It is certified that error appears in the above-identified patent and that said Letters Patent is hereby corrected as shown below:

Replace Column 1, lines 4-21 with the following paragraph;

---The invention relates to a frame component for a scaffolding frame of a stationary and/or movable scaffolding manufactured out of prefabricated structural components, which scaffolding frame is to be set up vertically, having two posts rigidly connected with one another adjacent their ends by cross-traverses which are horizontal in the operating state, and preferably circularly pipe-shaped in cross section. The posts each have at one end a first part closing off the respective post, for example an integrated pipe piece, and at the other end a second part complementary to the first part and projecting over the respective post, for example a bolt piece of a lockable plug coupling. The connections of the cross-traverses to the posts are provided with torsion-hindering reinforcements stabilizing the preferably rectangular shape of the frame component, and the upper cross-traverse is constructed continuously and is connected directly to the posts.---

UNITED STATES PATENT AND TRADEMARK OFFICE

CERTIFICATE OF CORRECTION

PATENT NO. : 5 901 810

DATED : May 11, 1999

INVENTOR(S) : Guenther KRAUSE

It is certified that error appears in the above-identified patent and that said Letters Patent is hereby corrected as shown below:

Column 1, line 24; insert

---Such a frame component is known from the GB-A-2 032 504.---.

Replace Column 1, line 63 through Column 2, line 44 with;

---This purpose is attained by the characteristics of Claim 1.---.

Column 6, line 36; delete "brackets".

Column 6, line 42; delete ",".

after "cross-traverse" insert

---,---.

Column 6, line 44; replace "to respective ones" with

---to the opposing ends---.

UNITED STATES PATENT AND TRADEMARK OFFICE

CERTIFICATE OF CORRECTION

PATENT NO. : 5 901 810

DATED : May 11, 1999

INVENTOR(S) : Guenther KRAUSE

It is certified that error appears in the above-identified patent and that said Letters Patent is hereby corrected as shown below:

Column 7, line 4; delete ", horizontal".

Signed and Sealed this

Twenty-sixth Day of December, 2000

*Attest:*

Q. TODD DICKINSON

*Attesting Officer*

*Director of Patents and Trademarks*